US005405257A

United States Patent [19]

Smith

[11] Patent Number: 5,405,257

[45] Date of Patent: Apr. 11, 1995

[54] APPARATUS FOR PRODUCING A ROLLED TAB FOR A ROLL OF PLASTIC FILM

[75] Inventor: Terry B. Smith, Midland, Mich.

[73] Assignee: Dowbrands L.P., Indianapolis, Ind.

[21] Appl. No.: 979,725

[22] Filed: Nov. 20, 1992

Related U.S. Application Data

[63] Continuation-in-part of Ser. No. 812,239, Dec. 19, 1991, Pat. No. 5,238,641.

[51] Int. Cl.[6] ..... B29C 53/34

[52] U.S. Cl. ..... 425/387.1; 264/500; 264/285; 264/310; 264/339; 425/402; 425/403.1

[58] Field of Search ..... 264/280, 285, 310, 339, 264/500; 425/402, 403, 403.1, 387.1; 242/148; 198/384, 779

[56] References Cited

U.S. PATENT DOCUMENTS

| | | | |
|---|---|---|---|
| 3,210,449 | 10/1965 | Talalay et al. | 425/402 |
| 3,945,495 | 2/1976 | Carmbody et al. . | |
| 4,169,122 | 1/1979 | Lefevre et al. . | |
| 4,241,127 | 7/1980 | Lefevre et al. . | |
| 4,243,366 | 3/1981 | Lefevre et al. . | |
| 4,804,513 | 2/1989 | Smith . | |
| 4,925,028 | 5/1990 | Smith . | |
| 5,238,641 | 8/1993 | Smith | 264/280 |

*Primary Examiner*—Mathieu D. Vargot

[57] ABSTRACT

An apparatus for forming a rolled tab on a roll of plastic film including a trunion roller-type conveyor apparatus and a traction device having a tractional surface wherein a roll of plastic film contacts the traction device such that the leading edge of the roll of plastic film is grabbed and rolled back to form a rolled tab for the roll of film when a roll of plastic film comes in rotational contact with the traction device.

13 Claims, 7 Drawing Sheets

APPARATUS FOR PRODUCING A ROLLED TAB FOR A ROLL OF PLASTIC FILM

CROSS REFERENCE TO RELATED APPLICATIONS

This is a continuation-in-part of U.S. patent application Ser. No. 812,239, filed Dec. 19, 1991, by Terry B. Smith, issued Aug. 24, 1993, as U.S. Pat. No. 5,238,641, which is incorporated herein by reference.

BACKGROUND OF THE INVENTION

This invention relates to an apparatus and process for forming a rolled tab in the tail end portion of a plastic film wound on a core. The rolled tab provides a leading edge for a roll of household plastic film in order to provide a convenient grasping tab to start the roll.

Commercial plastic film for consumer use is customarily manufactured by winding plastic film on a core and packaging the roll in a dispensing container for retail sale. The plastic film has a tail end portion extending around the surface of the roll and terminating at a tail edge. The plastic film is customarily manufactured with a clinging or adhesive surface to enhance its function as a wrapping material such as, for example, Saran Wrap TM or Handi-Wrap TM (trademarks of The Dow Chemical Company) films commonly used as household wrappings. Because of the clinging characteristic of the film, the tail end portion sticks to the surface of the roll making it difficult to identify and grasp the tail edge in order to separate the tail end portion from the surface of the roll without tearing it. The need for finding the tail edge of the film on the roll of plastic film and starting to unwind it without tearing has been long recognized, particularly with plastic film having considerable cling. Hence, roll-starting features have been used in the past to facilitate peeling the tail end portion of the film away from the surface of the roll.

U.S. Pat. Nos. 4,804,513 and 4,925,028, which are incorporated herein by reference, disclose one successful means of providing a rolled tab in a roll of plastic film. The rolled tab, produced by the process and apparatus disclosed in the above patents, helps the consumer find the starting edge of the roll.

The above patents disclose an apparatus adapted for use on a conveyor line to form a rolled tab in the tail end portion of plastic film wound on a roll of plastic film moving on the conveyor line. The tail end portion initially extends circumferentially around the surface of the roll to which the tail end portion adheres and terminates at a tail edge. The apparatus comprises a bucket which is connected to the conveyor line for movement thereon and has a floor and wall extending therefrom. The floor of the bucket has a tractional surface supporting the roll and the wall has a substantially frictionless surface pushing the roll in the direction of the conveyor line. The apparatus further comprises a drive means, extending in a stationary position substantially parallel to the conveyor line and having a resilient tractional surface being compressed into rotational contact with the roll for rotating the roll. The drive means rotates the roll to rub the surface of the roll against the tractional surface of the floor in the same direction that the tail end portion initially extends along the surface of the floor separates the tail end portion from the surface of the roll and rolls the tail edge back on the tail end portion upon successive revolutions of the roll to form a rolled tab containing the tail edge.

U.S. Pat. Nos. 4,804,513 and 4,925,028, also disclose a means, extending in a stationary position substantially parallel to the conveyor line, for blowing air tangentially along the circumferential surface of the roll and against the tail end portion on successive revolutions to assist in separating and rolling the tail end portion of the plastic film.

U.S. Pat. Nos. 4,804,513 and 4,925,028, further disclose a method for forming a rolled tab in the tail end portion of a roll plastic film wound on a core. The roll is propelled along a resilient tractional surface to rotate the roll in the same direction that the tail end portion initially extends along the surface of the roll. The roll is then pressed between the resilient tractional surface and a diametrically opposed moving contact position with a force of sufficient magnitude to compress the resilient tractional surface to form an arc of contact of sufficient length with the roll to maintain traction therebetween. The rotating surface of the roll is then rubbed at the moving contact position while maintaining the traction between the roll and the resilient tractional surface to separate the tail end portion from the surface of the roll and roll the tail edge back on the tail end portion upon successive revolutions of the roll to form a rolled tab containing the tail edge.

The product of the method and apparatus described in U.S. Pat. Nos. 4,804,513 and 4,925,028, is a roll of plastic film which comprises a core and plastic film wound on the core. The plastic film has a clinging surface and a tail end portion on the surface of the roll wherein the tail end portion terminates at a tail edge. The tail edge is rolled back on the tail end portion to form a rolled tab containing the tail edge. As a result, the rolled tab facilitates identifying and grasping the tail edge to initiate use of the roll.

While the apparatus and process described in U.S. Pat. Nos. 4,804,513 and 4,925,028 have experienced success in providing a rolled tab for a roll of plastic film, it is desired to provide an alternative apparatus and method for providing a rolled tab in the roll of plastic film in order to help the consumer find the starting edge of the roll. More particularly, it is desired to provide another apparatus and method which is readily adaptable to existing processing equipment and which can be used with other processing equipment, for example, equipment for applying a coupon in the package of a roll of film.

SUMMARY OF THE INVENTION

One aspect of the present invention is directed to an apparatus for forming a rolled tab on a roll of plastic film wound on a core comprising:

(a) a trunion roller conveying means having a plurality of rotatable trunion rollers for conveying a roll of plastic film wound on a core to a traction device, said roll of plastic film wound on a core adapted to be supported on the trunion rollers;

(b) at least one traction device having a tractional surface for contacting a rotating roll of plastic film wound on a core;

(c) a means for rotating the roll of plastic film wound on a core supported on the trunion rollers prior to or substantially simultaneously while contacting the traction device; and (d) means for contacting the roll of plastic film wound on a core with the traction device's tractional surface such that the leading edge of the roll contacts the tractional surface and the leading edge is rolled back upon successive revolutions of the roll, said contact sufficient to form a rolled tab.

Another aspect of the present invention is directed to an apparatus for preparing a roll of plastic film wound on a core having a rolled tab comprising:

means for forming a roll of plastic film wound on a core, means for passing the roll of plastic film to a conveying means, means for conveying the roll of plastic film to a traction device, means for rotating the roll of plastic film on the conveying means, and means for contacting the rotating roll of film with the traction device.

Yet another aspect of the present invention is directed to a process for forming a rolled tab on a roll of plastic film wound on a core comprising the steps of (a) conveying a roll of plastic film wound on a core on a trunion roller conveying means having a plurality of rotatable trunion rollers for conveying the roll of plastic film wound on a core to at least one traction device having a tractional surface, said roll of plastic film wound on a core adapted to be supported on the trunion rollers;

(b) rotating the roll of plastic film wound on a core supported on the trunion rollers prior to or substantially simultaneously while contacting the traction device's tractional surface; and (c) contacting the rotating roll of plastic film wound on a core with at least one traction device having a tractional surface, said contact being with the traction device's tractional surface such that the leading edge of the roll contacts the tractional surface and the leading edge is rolled back upon successive revolutions of the roll, said contact sufficient to form a rolled tab.

Still another aspect of the present invention is directed to a process for preparing a roll of plastic film wound on a core having a rolled tab comprising:

forming a roll of plastic film wound on a core, passing the roll of plastic film to a conveying means, conveying the roll of plastic film to a traction device, rotating the roll of plastic film on the conveying means, and contacting the rotating roll of film with the traction device.

DETAILED DESCRIPTION OF THE PREFERRED EMBODIMENTS

Consumers and producers of plastic film recognize the need for the consumer to readily find the starting edge of a roll of plastic film in order for the consumer to start the use of the film product. Consumers have long complained about the difficulty in finding and peeling away the edge of a roll of household plastic film to start the roll for use. This difficulty is created because of the characteristic of the film to cling to the underlying layer or sticking to the surface of the roll making it difficult to identify and grasp the tail edge of the film in order to separate the tail end portion from the surface of the roll without tearing it. This long-felt need is satisfied with the present invention.

In accordance with the present invention a roll-starting feature is provided to a roll of plastic film wound on a core to make it easier to peel the tail end portion of the film away from the surface of the roll. The roll-starting feature is provided to a roll of plastic film without applying a foreign substance or heat to the tail end portion of the film and without using complex equipment. Instead, the present invention employs a traction device for incorporating into a conveyor system such as a chain and roller-type conveyor system used for transporting rolls of plastic film products to packaging machinery, wherein the traction device, in conjunction with the conveyor system, contacts a rotating roll of plastic film wound on a core such that a rolled tab is formed on the roll of plastic film.

Figure 1:
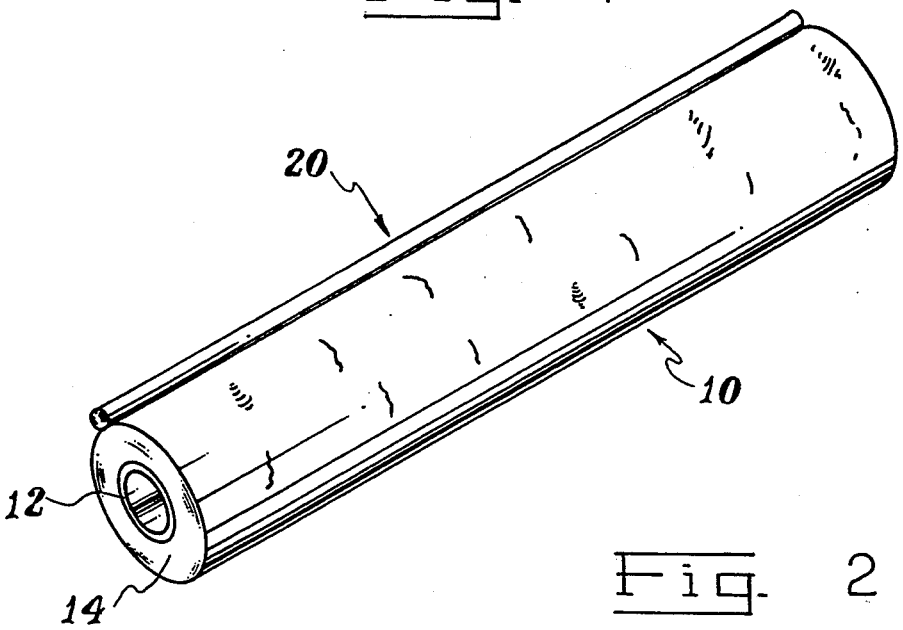
FIG. 1 is a perspective view of a roll of film wound on a core and a rolled tab formed in the tail end portion of the film in accordance with the present invention.
Figure 2:
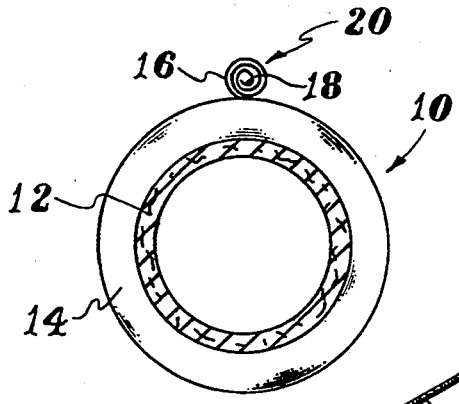
FIG. 2 is an end view of the roll of film of FIG. 1.

Referring to FIGS. 1 and 2, a roll of plastic film wound on a core is indicated generally at 10 and comprises a paperboard core 12 and layers of plastic film 14 wound thereon. The plastic film 14 has a tail end portion 16 terminating at a tail edge 18. Initially, the tail end portion 18 of the plastic film 14 extends circumferentially around the roll 10 and adheres to the surface of the roll 10. The apparatus of the present invention, however, rolls the tail edge 18 back on the tail end portion 16 to form a rolled tab indicated generally at 20 which contains the tail edge 18. The rolled tab 20 is the roll-starting feature that facilitates identifying and grasping the tail edge 18.

The present invention is broadly applicable to known synthetic resinous films or wrapping materials which exhibit a high degree of clinging, whether from inherent characteristics, added clinging agents, or static charge. The plastic film 14 can be, for example, household films made of the vinylidene chloride copolymers (Saran Wrap TM films), polyvinyl chloride films, or film made of polyethylene homopolymers and copolymers (Hand-i-Wrap TM films), as long as the plastic film 14 exhibits the clinging characteristic. The present invention utilizes this clinging characteristic to form the rolled tab 20. When the tail end portion 16 is rolled back on itself in a direction opposite the direction that the plastic film 14 is wrapped on the roll 10, the partially rolled tab 20 holds together during successive revolutions of the roll 10 because of the clinging characteristic. Thus, a roll-starting feature is formed without applying a foreign substance to the film 14 or heating the film 14 and without complex electronic synchronizing equipment.

The tail edge 18 is typically rolled back about three revolutions, but one full revolution is sufficient. The rolled tab 20 typically is formed from about 1.0 to 1.25 inches of the tail end portion 16 of the film 14 and has a diameter which is typically about 1/16 inch. Because of the clinging characteristic, the rolled tab 20 maintains this shape and does not collapse from vibration when the roll 10 is transported to consumer markets.

The roll 10 described herein is packaged within standard, consumer-type dispensing cartons such as for example, trunk-lid style cartons and conventional flap-lid style cartons. Trunk-lid style cartons are shown in various forms in U.S. Pat. Nos. 2,096,837, 2,226,477; 3,118,581; 3,129,870 and 3,549,066, and the conventional flap-lid style carton is shown in various forms in U.S. Pat. Nos. 1,972,069; 2,433,445, 2,463,375; 2,472,521; 2,624,501 and 2,888,181. The disclosures in these patents are incorporated herein by reference.

Figure 4:
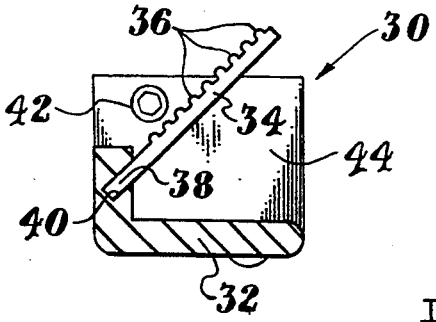
FIG. 4 is a cross sectional view of the traction device of FIG. 3 taken along reference line 4—4.
Figure 3:
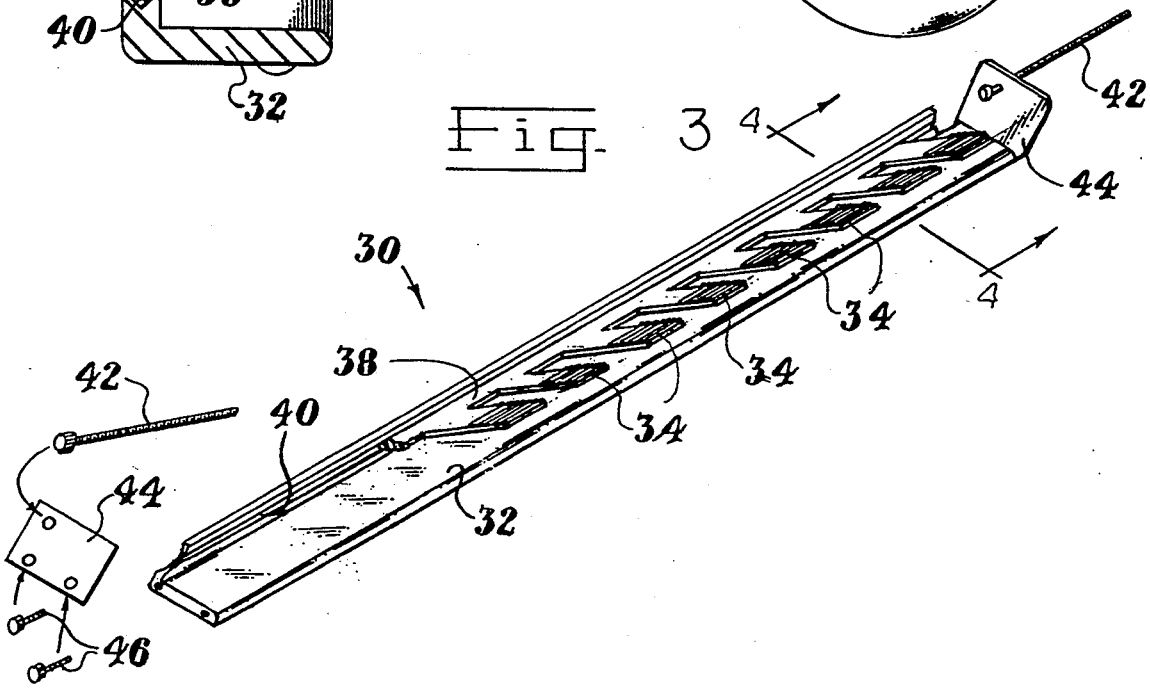
FIG. 3 is a perspective view of one embodiment of a traction device in accordance with the present invention.
Figure 5:
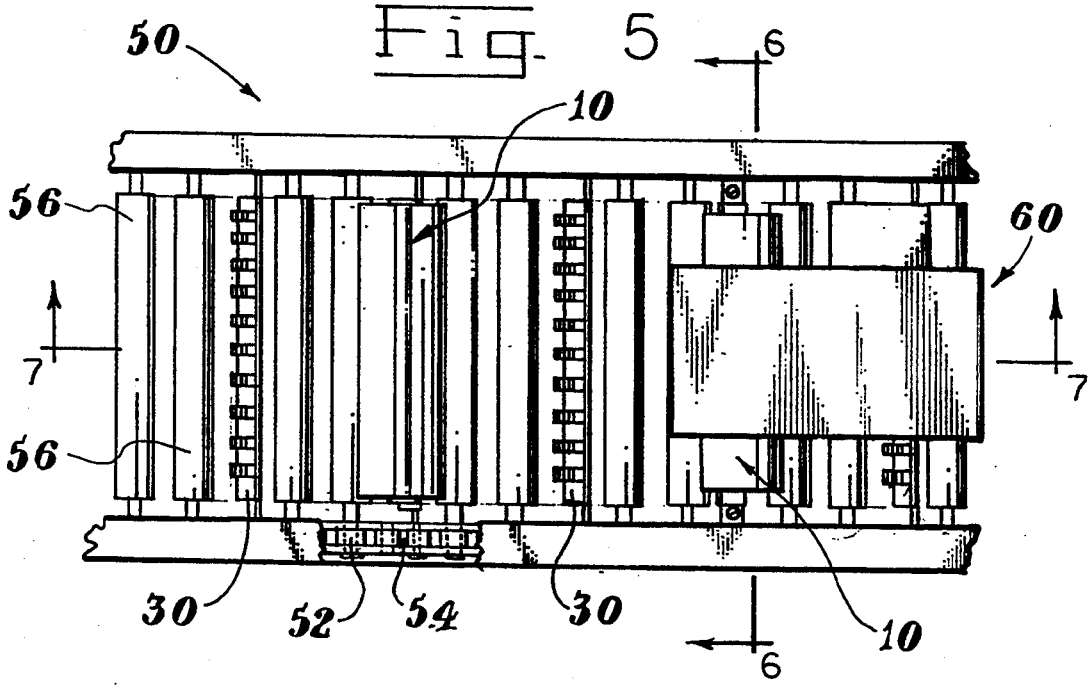
FIG. 5 is a partly broken away and partly schematic plan view of an apparatus for forming a rolled tab on a roll of film in accordance with the present invention.
Figure 6:
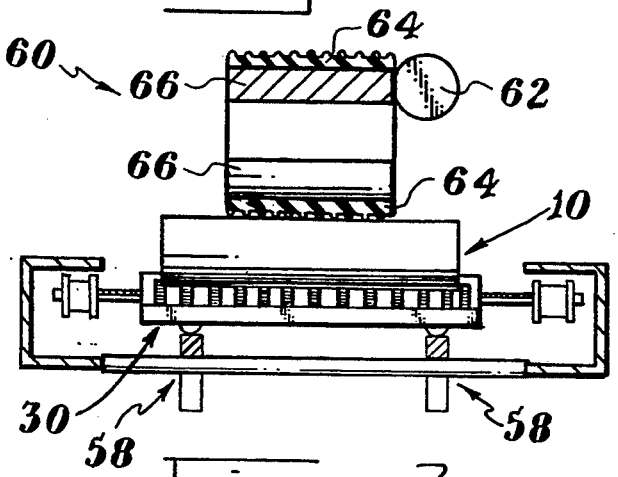
FIG. 6 is a cross-sectional view of FIG. 5 taken along the reference line 6—6.
Figure 7:
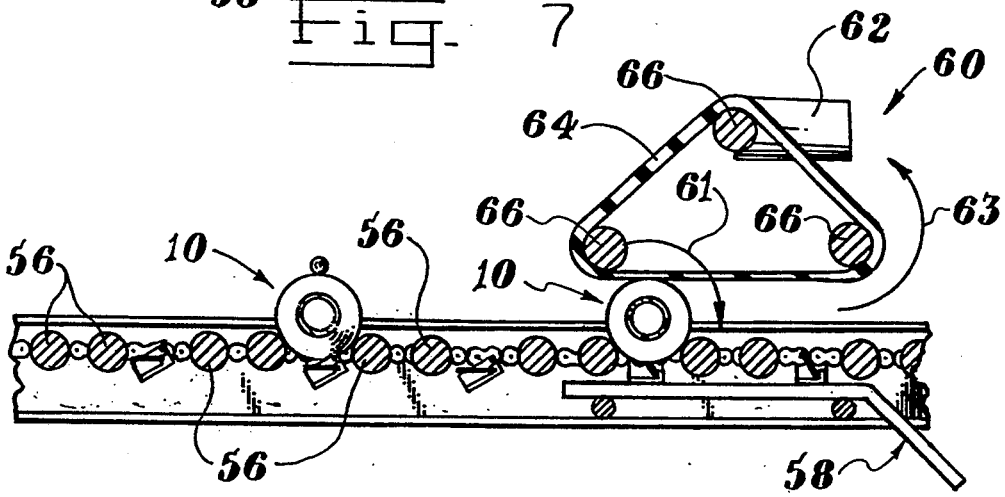
FIG. 7 is a cross-sectional view of FIG. 5 taken along the reference line 7—7.
Figure 8:
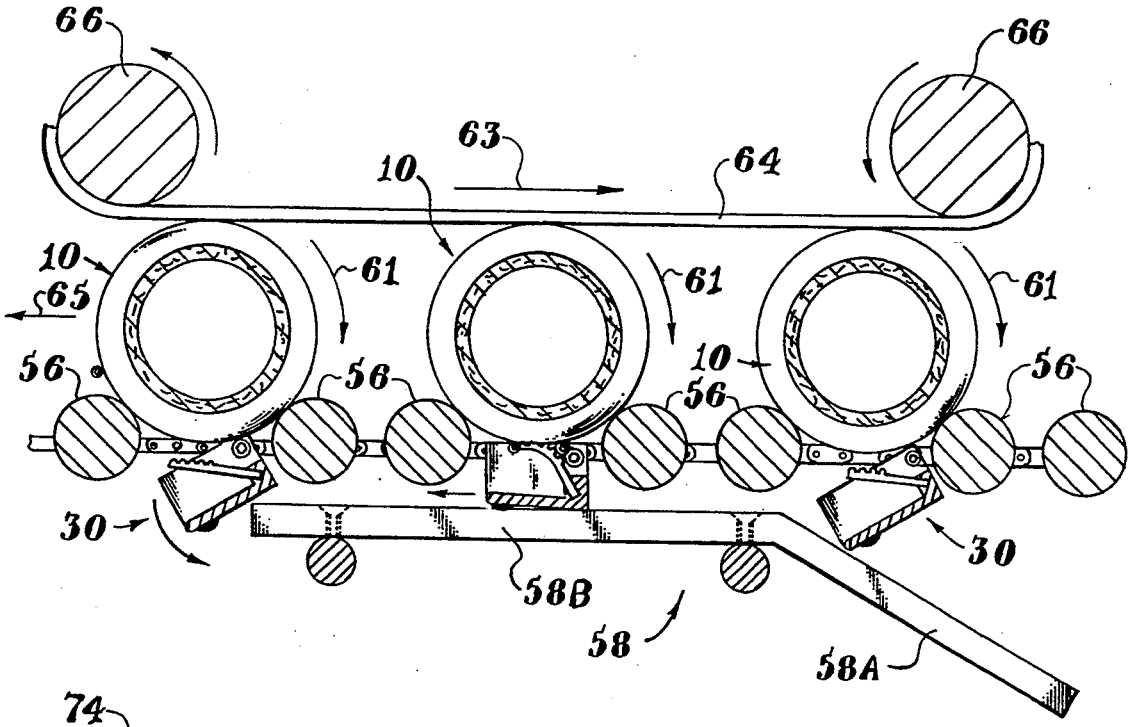
FIGS. 8–11 are partly broken away and partly cross-sectional views of portions of various embodiments of apparatuses of the present invention.

Generally, the process of the present invention is carried out by employing a traction device such as shown in FIGS. 3 and 4 in combination with a conveyor line such as shown in FIGS. 5–8. Other embodiments of a traction device in combination with a conveyor system are shown in FIGS. 9–15.

The process of the present invention can be carried out using any of the apparatuses schematically illustrated in FIGS. 5–15 which generally includes a conveyor line for transporting a roll product to a further packaging process and dispenser such as described above. The traction device is incorporated into the conveyor line assembly such that during operation of the conveyor line, the device "grabs" the leading edge 18 of the roll of plastic film 14 and forms roll tab 20 as the roll 10 is transported to another location on the conveyor line.

The preferred embodiment of the insert device of the present invention includes a support bar member having attached thereto at least one resilient finger member 34 and more preferably a plurality of spaced apart fingers 34, said fingers 34 having a means for grabbing and rolling the leading edge of a roll of plastic film such that a rolled tab for the roll of film is formed.

One embodiment of the traction device of the present invention is illustrated, in more detail, in FIGS. 3 and 4 and indicated generally at 30 and will herein be referred to as "the insert device 30." At least one insert device 30 is adapted to be positioned adjacent and parallel between at least two rollers of a trunion-roller type conveyor apparatus for conveying a roll of plastic film (see FIGS. 5–8). The roll 10 is supported on the surface of the trunion rollers and the insert device 30 having a tractional surface is used for grabbing and rolling the leading edge of a roll of plastic film such that a rolled tab for the roll of film is formed when a roll of plastic film comes in rotational contact with the insert device 30.

One preferred embodiment of the insert device 30 for forming a rolled tab on a roll of plastic film 10 comprises an elongated support member 32 adapted to be inserted in a parallel position and in supporting relation between two roller members of a trunion-type conveyor apparatus. The support member 32 has a tractional surface which engages the roll 10 from the bottom surface of the roll 10 which is riding on the relative top surface of the trunion rollers. The tractional surface is used for grabbing and rolling the leading edge of a roll of plastic film such that a rolled tab for the roll of film is formed when a roll of plastic film comes in rotational contact with the insert device.

The insert device 30 comprises a support bar member 32, and in this instance, is an L-shaped member when viewed in cross section, having attached thereto at least one resilient traction member 34 having a tractional surface for contacting the plastic film 14 of the roll 10 such that rolled tab 20 is formed on the roll 10.

The traction member 34, in this instance, is preferably a plurality of flexible finger-like members 34 generally spaced apart and attached to the support member 32 at a sufficient angle to grab and roll the leading edge 18 of a roll of plastic film 14 when the roll of plastic film 14 is in rotational contact with the insert device 30. The number and spacing of the fingers is not critical, but should be sufficient to provide a sufficient tractional surface for "grabbing" the leading edge 18 of the roll of plastic film 14 in a uniform manner. Typically, the fingers are spaced ⅛ inch apart and can be as many as 32 to 48 in number. In another embodiment, however, the traction member 34 can simply be a solid flexible flat plate member (not shown) having a continuous contact surface with roll 10. Accordingly, the whole contact surface along the longitudinal length of roll 10 can be in uniform contact with the traction member 34 or only partial or intermittent contact with the traction member 34.

The traction member 34 is attached by any suitable attachment means, such as screws or adhesives, to the support member 32 substantially perpendicular to and along the longitudinal axis of the support member 32 at an angle sufficient to contact the roll 10 but not to jam or stop the rotation of the roll 10. In FIGS. 3 and 4, the base 38 of the traction member 34 is attached to the support member 32 with adhesive in a groove 40. With regard to the insert device 30, generally, the angle can be essentially flat (0 degrees) and up to about 45 degrees, preferably from about 10 degrees to about 30 degrees.

The fingers 34 contain a resilient tractional surface 36 for providing a surface for rotational contact with the roll of film 10. The fingers 34, as a whole, are preferably made of flexible or non-permanently deformable material such as rubber or urethane and the surface 36 of one side of the fingers is preferably ribbed and grooved when viewed in cross section. The fingers 34 can be made, however, of a combination of two or more layers wherein the surface layer contains an irregular, embossed, roughened, knurled or knobby-treaded surface sufficient for "grabbing" the leading edge 18 of the roll of plastic figure film 14. By employing the fingers in the present invention, the apparatus of the present invention can accept rolls 10 of different diameters and/or rolls with loose or tight winds without deformation or damage to the film. The fingers provide ease of rotation and do not impede free rotation. In addition, each finger works independently without affecting the function of adjacent fingers. Thus, the flexible fingers deform to irregularities in the surface of a roll of film, i.e., the traction device contacts the entire length of the roll without sacrificing contacting surface.

With reference to FIGS. 5–8, the insert device 30 is shown inserted into a conveyor system 50 comprising a drive chain 52 with links 54 and sprockets (not shown) and rotatable rollers 56. The rollers 56 are longer than the roll 10 and support the entire length of the roll 10 on the surface of rollers 56. The rollers 56 allow for friction-free rotation of roll 10 which allows for less susceptibility to damage to roll 10. The insert device 30 is easily adapted to the chain and roller type conveyor system 50, and in operation, utilizes the ability of the product to be rolled freely while being conveyed to packaging machinery. The insert device 30 is transversely supported at each end to the conveyor 50 by bushing equipped links 54 in the drive chain 52 and the device's longitudinal axis is substantially parallel to the rollers 56.

The insert device 30 is releasably attached to the conveyor 50 by threaded pins 42 mounting brackets 44 and screws 46 at each end of the device (shown in FIG. 3) such that the device can freely rotate on a single axis. In operation, as the insert device 30 travels in a horizontal direction without contacting a roll 10, the device remains tilted downwardly so that the fingers 34 are in a horizontal position and can not make contact with the roll 10 until the insert device 30 is biased against the rotating roll 10. The insert device 30 is forced into a contact position with the rotating roll 10 by employing a plow rail member 58 shown in FIGS. 6–8.

As the insert device 30 travels along the top surface of member 58 at its incline ramp portion 58A, the fingers of the device begin to orient themselves at an angle as the insert device 30 travels toward the horizontal portion 58B. When the insert device 30 reaches the portion 58B, the insert device engages the roll 10. The angle of the fingers are oriented at an angle sufficient to contact the roll 10, for example at about a 21 degree angle, until the insert device rides off the horizontal surface portion 58B of member 58 wherein the insert device returns to its original tilted position. The insert device 30 contacts the roll 10 for a period sufficient to form a rolled tab 20 on the roll 10. Then, after the rolled tab has been formed, the insert device will disengage from contact with the roll and return to its original tilted position to avoid further contact with the roll 10.

An overhead drive means, generally indicated at 60, is used to ensure rotation of the roll of film 10 positioned above the insert device 30 in the direction indicated by arrow 61. The drive means 60 may comprise a drive assembly including a drive motor 62, traction belt 64 having a tractional surface rotating about rollers 66 in the direction indicated by arrow 63. The rollers 66 and belt 64 are driven by the drive motor 62. The tractional surface may be knobby-treaded surface or grooved-shape like the fingers 34 and is used for rubbing the surface of roll 10 while roll 10 rotates freely on the surface of two adjacent rollers 56. The rollers 56 rotate due to frictional contact with product roll 10 and the rollers 56 are moved in the machine direction (indicated by arrow 65) by a separate drive means (not shown) connected to the conveyor system 50. The speed of the conveyor drive means can be adjusted independently of the drives means 60 that rotates the product roll 10. The drive assembly 60 is positioned in a plane substantially parallel to and above the conveyor line and presses the belt 64 against the roll 10 as the roll 10 travels between the belt 64 and conveyor line rollers 56.

In operation, the insert device 30 is plowed up by a plow rail member 58 to make contact with the product while the products moves under the overhead drive system 60 such that the roll product rotates in the opposite direction of the roll products original wind; the rolled product having been wound by conventional film winding machinery.

The insert device 30 equipped with the fingers 34, for example, of soft urethane material gently grab and roll back the terminal end of the film product thus creating a highly visible and durable portion for the consumer to grasp and start the product for greater ease in usage.

The insert device 30 travels on the surface of rail member 58 and is then allowed, by gravity, to swing down off of the end of plow rail 58 to where the insert 30 rides below a point at which insert 30 no longer contacts the product roll 10 surface and will not interfere with additional packaging steps or other additional processes down stream from the point of formation of the rolled tab. For example, an additional process which can be used with the present invention in packaging a roll 10 is application of incentive coupons.

The conveyor line 50 transports the roll 10 under the drive assembly 60 rotating the rubber belt 64 which in turn rotates the roll 10 in the direction 61 indicated by arrows. The roll 10 rotates on the surface of the rollers 56 and belt 64 against the knobby-treaded surface of the rubber belt 64 in the same direction that the tail end portion 16 initially extends along the surface of the roll 10. As the insert device 30 contacts the roll 10, surface 36 separates the tail end portion 16 from the surface of the roll 10 and rolls the tail edge 18 back after one revolution. The tractional surface 36 continues to roll back the tail end portion 16 on itself upon successive revolutions to form the rolled tab 20. Although the partially rolled tab 20 is flattened each time it is rolled against the surface 36, the plastic film 14 is sufficiently resilient so that the rolled tab 20 returns to its cylindrical shape after being flattened. The drive assembly 60 provides enough pressure to the roll 10 so that the rotational contact is of a sufficient length of time to provide enough traction to overcome the rubbing force of the tractional surface 36 without substantial slippage. It has been found that the requisite pressure depends upon the length or width of the rollers 66 and the rubber belt 64 across the roll 10, which should be approximately ½ of the axial length of the roll 10 so that enough pressure can be applied without deforming the roll 10.

The tips of the knobby-treaded surface 36 are intended to grab the tail edge of 18 of the plastic film 14 as the roll 10 is rotated above the insert device 30. The apparatus of the present invention may also comprise means for blowing air tangentially along the circumferential surface of the roll 10 and against the tail end portion 16 on successive revolutions to assist in separating and rolling the tail end portion 16 of the plastic film 14. Such means for blowing can be an air manifold 70 as shown in FIG. 9.

Figure 9:
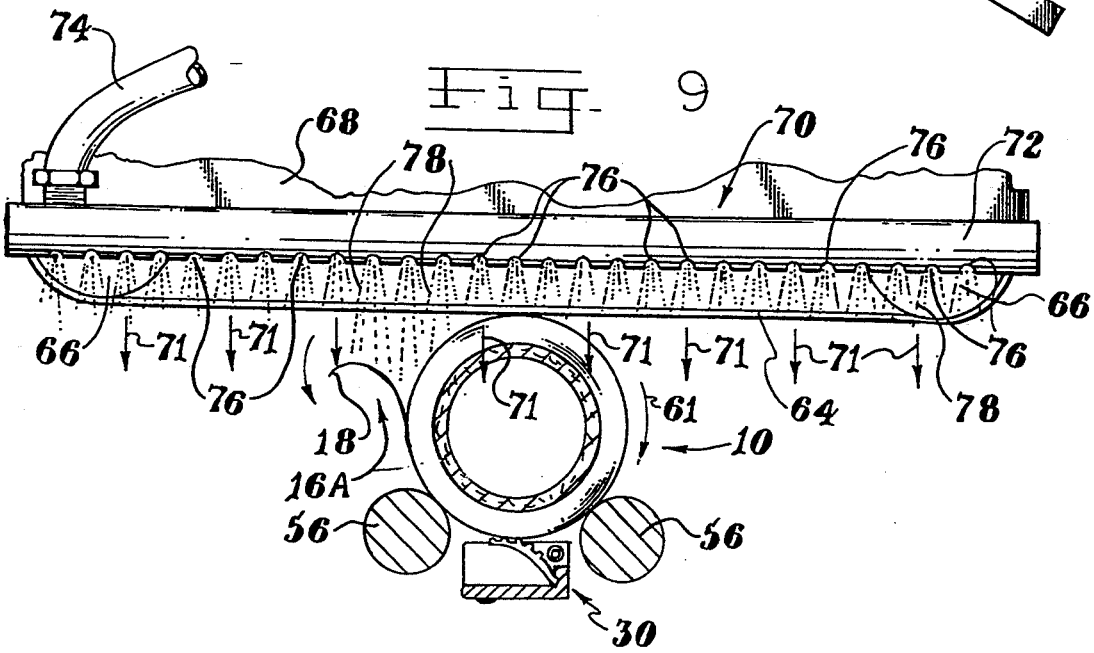

With reference to FIG. 9, the air manifold 70 can be, for example, a steel tube 72 sealed at both ends and having an inlet 74 for receiving compressed air and a plurality of outlet 76 axially aligned along the wall of the tube to blow air 78, in the direction indicated by the arrows 71 on the circumferential surface of the roll 10 while it rotates (in the direction indicated at 61) along the conveyor line on rollers 56.

In a preferred embodiment, two air manifolds 70 are used one each side of the drive means 60 and supported over each end of the roll 10 by brackets (not shown) secured to for example a metal guard plate or shroud 68 of the drive means 60 so that the manifolds extend in a plane above and substantially parallel to the conveyor line. The outlets 76 can be angled, at approximately 30 degrees from the surface of the manifold 70, or direct jets of air 78 generally downstream in the direction 71 of the conveyor line against the tail end portion 16 of the plastic film 14. As the roll 10 rotates along the rollers 56 and belt 54, the jets of air 78 hit the tail edge 18 of the tail end portion 16 to separate the tail end portion 16 from the surface of the roll 10 as indicated at 16A. The air jets 78 assist in rolling the tail end portion 16 upon successive revolutions of the roll 10 to form the rolled tab 20.

The process of the present invention thus includes the steps of propelling the roll along a conveyor means and rotating the roll on the conveyor means and contacting the rotating roll with a traction device having a resilient tractional surface to rotate the roll in the opposite direction that the tail end portion initially extends along the surface of the roll and rubbing the rotating surface of the roll at a moving contact position while maintaining traction between the roll and the resilient tractional surface to separate the tail end portion from the surface of the roll and roll the tail edge back on the tail end portion upon successive revolutions of the roll to form the rolled tab containing the tail edge.

The process of the present invention may further comprise the step of blowing air tangentially and circumferentially along the rotating surface of the roll and against the tail end portion of the film on successive revolutions to assist in separating and rolling the tail end portion of the film.

The insert device 30 and trunion-type conveyor 50 is useful to implement a starting feature 20 on a roll of polyethylene film when associated with other mechanical type drive equipment.

The insert device 30 applies a superior starting feature on a roll of polyethylene film by means of rolling the products trailing edge against a row of gentle urethane fingers of very high traction quality. The result is a starting feature of "friendly" characteristics which is very compatible with other packaging applications.

Figure 10:
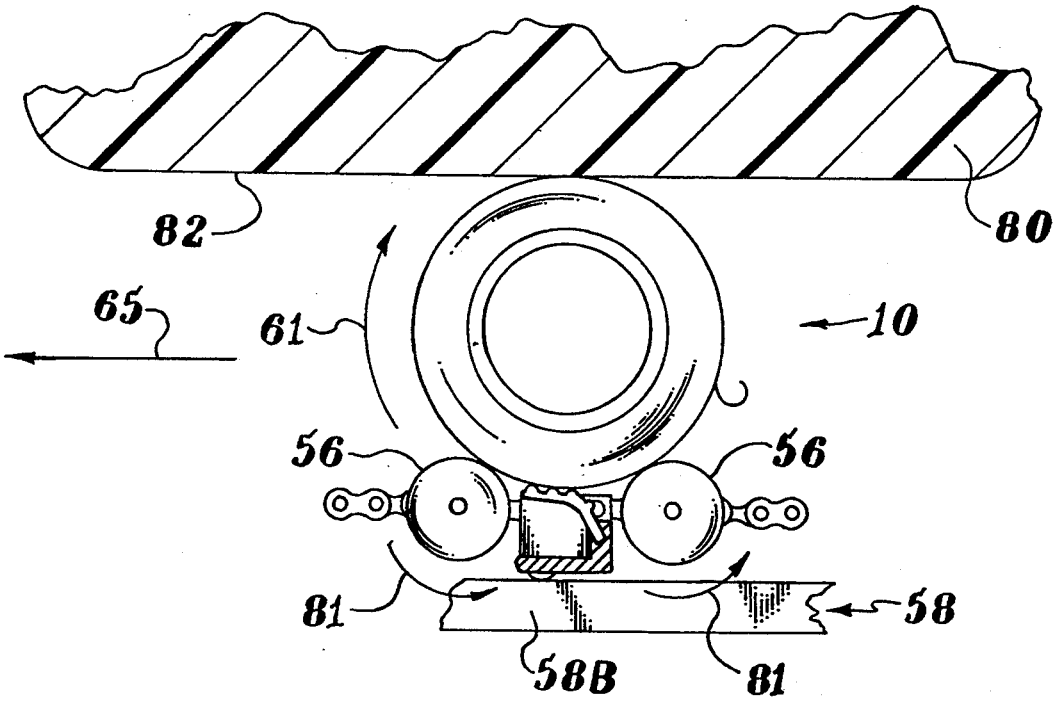

With reference to FIG. 10, there is shown another embodiment of the present invention including insert device 30 inserted in a trunion-roller type conveyor line 50 having rollers 56 rotated by a drive means (not shown), which can be, for example, an adjustable driven belt in tangential contact with the trunion rollers 56, in the direction indicated by arrows 81. As shown in FIG. 10, a roll product 10 is conveyed on rollers 56 between a stationary member 80 having a frictionless surface 82. The member 80 acts like a retaining member for captivating a roll of plastic film 10 between trunion rollers 56 and a stationary elevation of the member 80 such that the roll of film is maintained in rotational movement and contact on the rollers 56 and member 80 as the roll 10 passes between the member 80 and rollers 56. The stationary member 80 is positioned in a plane above and substantially parallel to the conveyor line 50 similar to the drive means 60 in FIG. 9 except that in this embodiment, the rollers 56 provide the necessary rotation to roll 10 while the member 80 remains stationary. As rollers 56 rotate in the direction indicated at 81, the roll product 10 rotates in the direction indicated by arrow 61. The frictionless surface 82 allows the roll 10 to maintain its position between rollers 56 as the conveyor moves the rollers 56 and roll 10 in the direction indicated by arrow 65 until a rolled tab is formed on the roll 10. Optionally, the conveyor 50 could also move in the opposite direction of arrow 65.

Figure 11:
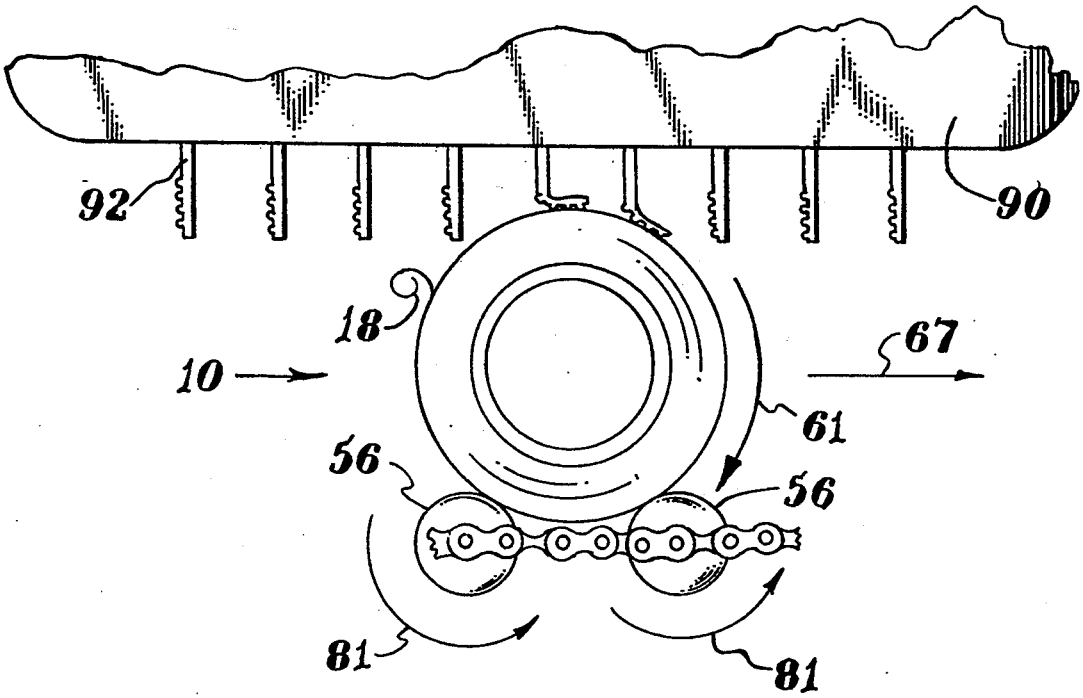
Figure 12:
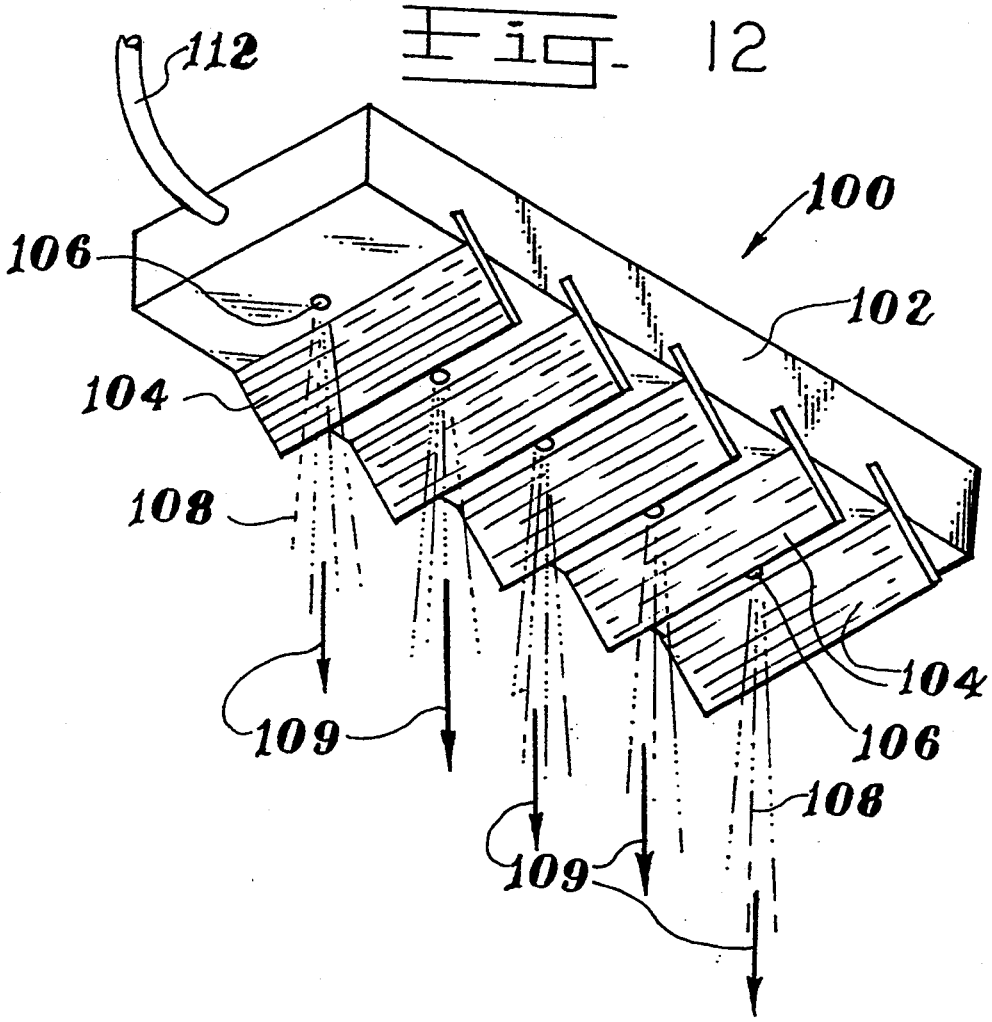
FIG. 12 is a perspective view of an other embodiment of a traction device in accordance with the present invention.
Figure 13:
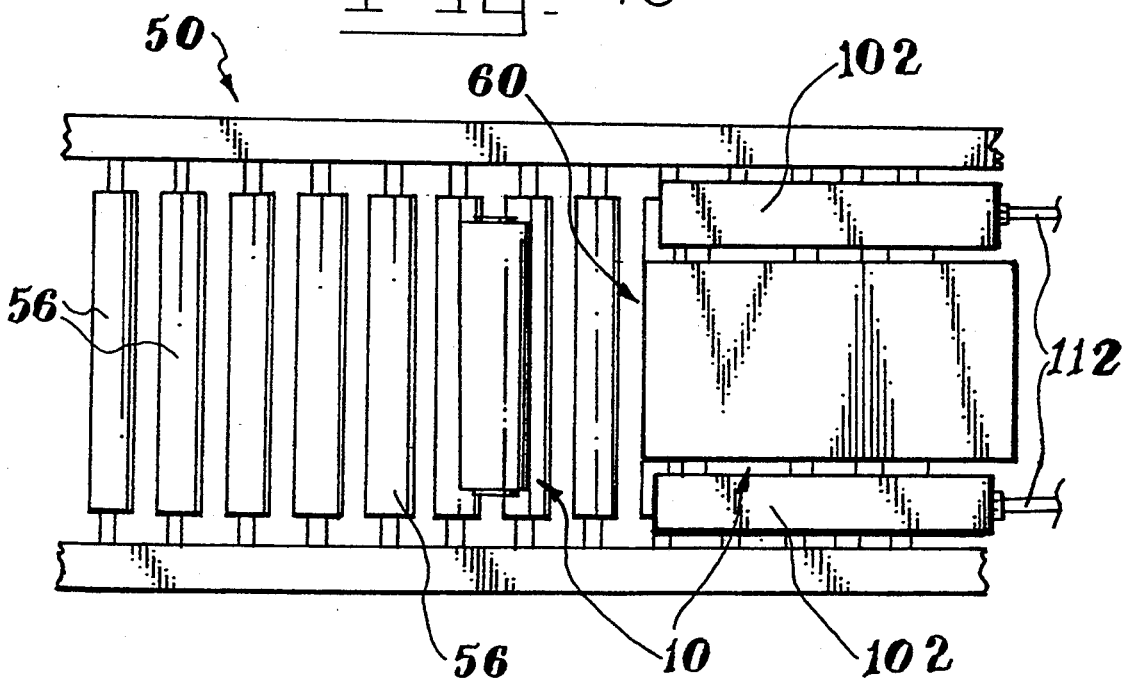
FIG. 13 is a partly broken away and partly schematic plan view of an apparatus for forming a rolled tab on a roll of film in accordance with the present invention.
Figure 14:
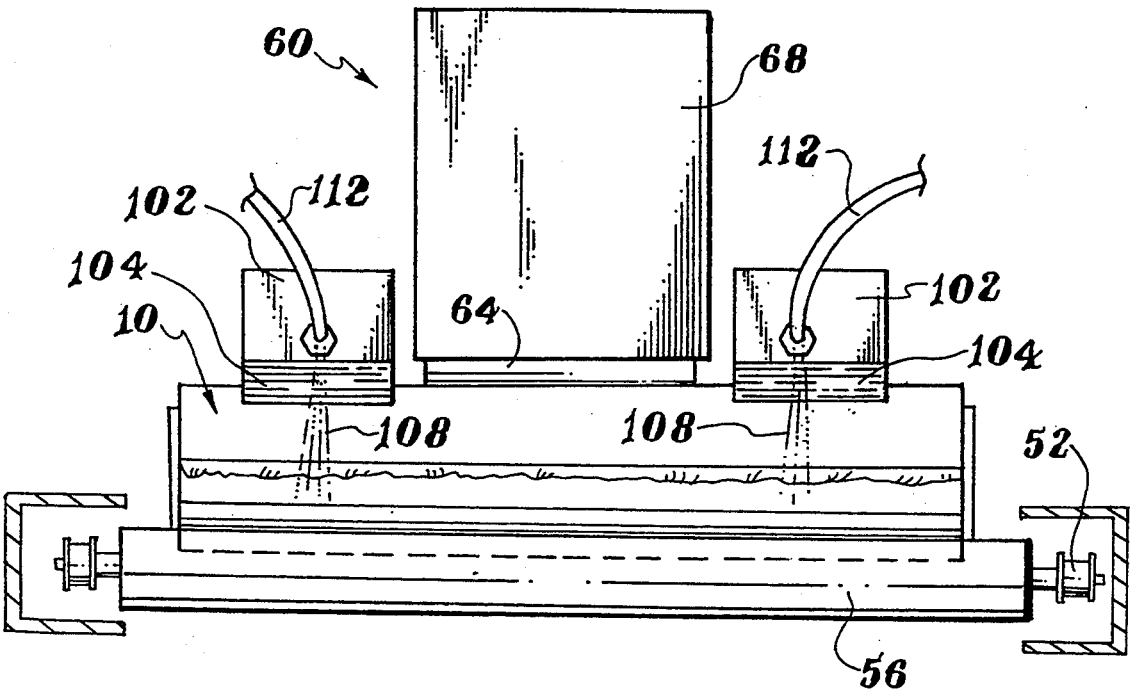
FIG. 14 is a cross-sectional view of FIG. 13 taken along the reference line 14—14.

With reference to FIG. 11, there is shown yet another embodiment of the present invention including a traction device 90, preferably stationary, having a tractional surface 92, in this instance, finger-like members of flexible material. The tractional surface 92 can be of the same type of surface described with reference to traction member 34. The surface 92 can also be made in the form of a mat-like surface of flexible material yet stiff enough material sufficient to grab the leading edge of plastic film of roll 10. The tractional surface, however, should not damage the film of roll 10.

As shown in FIG. 11, the rollers 56 are rotated by a drive means (not shown) in the direction indicated by arrows 81. The rollers 56, in turn, rotate the roll 10 in the direction 61 while the convey line moves in the direction indicated by arrow 67. The tractional surface 92 of member 90 then grabs the leading edge 18 of plastic film 14 of roll 10 to form the rolled tab 20. In another embodiment not shown, the roller members 56 can have a tractional surface on the circumferential surface of the rollers 56 for enhancing the friction and traction between the roll 10 and roller 56. The embodiments shown in FIGS. 10 and 11 can also include a means for blowing air tangentially along the circumferential surface of the roll 10 to enhance roll tab formation as described with reference to FIG. 9.

With reference to FIGS. 12–15, there is shown still another embodiment of the present invention including at least one traction device indicated generally by numeral 100, preferably stationary, comprising at least one manifold block member 102 having a tractional surface 104. Preferably, the traction system of the present invention comprises at least two separate manifold block members 100 adapted to be positioned adjacent each other on a parallel plane above the trunion rollers 56 of a trunion-roller type conveyor apparatus 50 for conveying a roll of plastic film 10. The roll 10 supported on the relative top surface of the trunion rollers 56 travels between the rollers 56 and beneath the bottom surface of the traction device 100. The traction device 100 has a tractional surface 104 in contact with the roll 10 for grabbing and rolling the leading edge 18 of a roll of plastic film 10 such that a rolled tab 20 for the roll of film 10 is formed when a roll of plastic film 10 comes in rotational contact with the traction device 100.

A preferred embodiment of the manifold block member 102 of the present invention includes a support block member 102 having attached thereto a tractional surface 104 comprising at least one resilient finger-like member 104 and more preferably a plurality of spaced apart finger-like members 104, said fingers having a means for grabbing and rolling the leading edge of a roll of plastic film such that a rolled tab for the roll of film is formed. In this instance, the plurality of finger-like members 104 is made of flexible material to make up the tractional surface 104. The tractional surface 104 can be of the same type of surface described with reference to traction member 34. The tractional surface 104 can also be made in the form of a mat-like surface of flexible material yet stiff enough material sufficient to grab the leading edge of plastic film of roll 10. The tractional surface, however, should not damage the film of roll 10.

Figure 15:
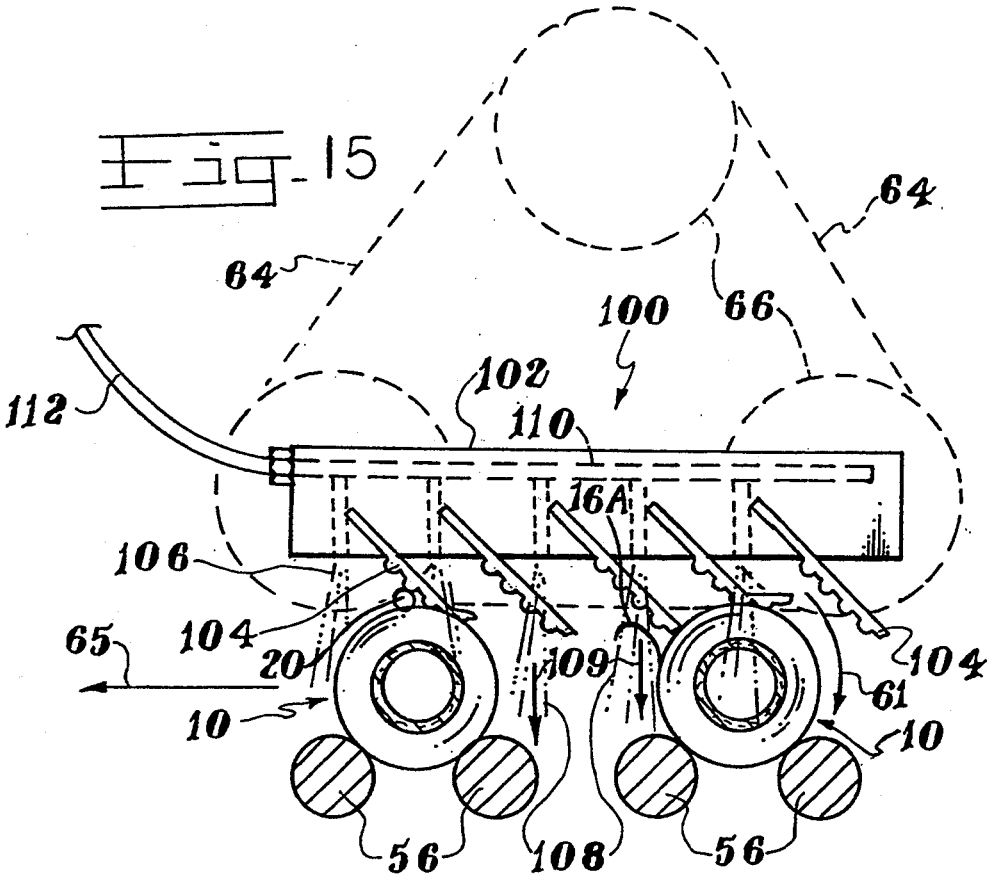
FIG. 15 is a cross-sectional view of FIG. 13 taken along the reference line 15—15.

As shown in FIG. 15, the roll 10 is transferred to the tractional surface 104 by conventional means, such as rollers 56 of a conventional trunion roller type conveyor means 50. The rollers 56 are freely rotatably supported on the conveying means and as the roll 10 is transferred past the tractional surface 104 while contacting the surface 104 (in the direction indicated by arrow 65), the finger-like members 104 grab the leading edge 18 of the roll 10 and form a starting roll tab 20. The fingers 104 protrude into the pathway of the roll 10 and the fingers 104 immediately deform by the top rotational surface of the roll 10. The surface speed of the rotating roll is preferably greater than the conveying line speed to ensure that the roll 10 is maintained in a rotational contact position, the roll undergoing sufficient revolutions in a short time to provide a rolled tab 20.

Sufficient pressure is applied on the roll 10 with the traction device 100 such that the finger 104 compresses on the roll 10 sufficient to deform the finger 10 without disturbing the position of the roll, that is, the roll does not "pop out" or "kick back" in the opposite direction of the conveyer rollers.

In an alternative embodiment not shown (but similar to FIG. 11), the rollers 56 can be rotated by a drive means (not shown). In this instance, the rollers 56, would in turn, rotate the roll 10 while the conveyor line moves in the direction indicated by arrow 65. The tractional surface 104 of member 100 then grabs the leading edge 18 of plastic film 14 of roll 10 to form the rolled tab 20. In another embodiment not shown, the roller members 56 can have a tractional surface on the circumferential surface of the rollers 56 for enhancing the friction and traction between the roll 10 and roller 56.

The preferred embodiment shown in FIGS. 12–15 includes a means for blowing air tangentially along the circumferential surface of the roll 10 to enhance roll tab formation similar to that described with reference to FIG. 9. In the preferred embodiment shown in FIGS. 12–15, the manifold block member 102 can be, for example, a steel block with an internal bore 110 sealed at one end and having an inlet tube 112 for receiving compressed air from a source (not shown) and a plurality of outlets 106 axially aligned along the bottom wall of the block 102 to blow air 108, in the direction indicated by the arrows 109 on the circumferential surface of the roll 10 while the roll 10 rotates (in the direction indicated at 61) along the conveyor line in rollers 56.

In a more preferred embodiment, two air manifold blocks 100 are used, one on each side of the drive means 60 and supported over each end of the roll 10 by brackets (not shown) secured to a frame means or bracket, for example a metal guard plate or shroud 68 of the drive means 60, so that the manifold blocks extend in a plane substantially parallel to the conveyor line 50. The outlets 106 can be angled, for example, at approximately 45 degrees from the surface of the manifold 102, to direct jets of air 108 generally downstream in the direction 109 of the conveyor line against the tail end portion 16 of the plastic film 14. As the roll 10 rotates along the rollers 56 and belt 54, the jets of air 108 hit the tail edge 18 of the tail end portion 16 to assist in separating the tail end portion 16 from the surface of the roll 10 as indicated at 16A. The air jets 108 assist in rolling the tail end portion 16 upon successive revolutions of the roll 10 to form the rolled tab 20.

An illustration of the embodiment shown in FIGS. 12–15 can be for example, a unit consisting of a metallic block 102 that is bored length-wise through the center of the block with several small holes 106 bored perpendicularly from one side to a depth sufficient to intersect the main bore 110. Between each small airstream hole 106 a urethane "finger" 104 is fastened to the metallic block at an angle of approximately 45 degrees. The fingers 104 extend approximately ½ inch and are shaped in a manner such that the fingers 104 do not impede the air 108 that escapes from the series of equally spaced holes 106. One complete unit 100 is fastened to each side of the drive system 60 that uses a powered belt 64 to turn a roll of polyethylene food wrap 10 while the roll 10 passes beneath the belt 64 on the trunion conveyor system 50.

In carrying out the process of the present invention using the embodiment shown in FIGS. 12–15, compressed air is introduced at one end of the main bore 110 via air inlet tube 112. The opposite end of the lengthwise bore 110 is plugged so that air escapes through the small holes 106 to provide several equally spaced airstreams 108 that flow generally perpendicularly from the block 102. The airstreams 108 and traction fingers 104 are directed down toward the product roll 10. The fingers 104 contact the roll 10 with sufficient force to form a rolled tab, but not enough force to prevent the drive belt from turning the roll 10 as the roll rides on top of steel rollers 56 carried by the trunion conveyor.

The pressure of the supply air (not shown) is regulated so that sufficient air velocity is obtained from the series of equally spaced holes 106 to disturb and lift the tail end portion 16 of film 14 from the surface of the product roll 10. The tail end portion 16 is repeatedly exposed to the several airstreams 108 and is wiped back in incremental steps as contact is made with the urethane fingers 102 during every complete rotation.

The result is a tail section or rolled tab 20 of product film roll 10 that can be readily identified as the starting point. This starting feature portion of the roll 10 also stands slightly away from the surface of the product roll 10 to facilitate ease in grasping and initiating product usage.

The systems of the present invention described above, not only provide a superior starting feature, but are very forgiving of product irregularities such as roll diameters from separate conventional wind machines. The process and apparatus of the present invention can be used along with and just prior to conventional coupon application hardware.

Having described the present invention in detail and by reference to preferred embodiments thereof, it will be apparent to those skilled in the art that other modifications and variations to the present invention are possible without departing from the scope of the present invention defined in the appended claims.

What is claimed is:

1. An apparatus for forming a rolled tab on a roll of plastic film wound on a core and presenting a leading edge comprising:

(a) a trunion roller conveying means having a plurality of rotatable trunion rollers for conveying a roll of plastic film wound on a core to a traction device;

(b) at least one stationary traction device having a tractional surface for contacting a rotating roll of plastic film wound on a core;

(c) a means for rotating the roll of plastic film wound on a core supported on the trunion rollers prior to or substantially simultaneously while contacting the traction device; and (d) means for contacting the roll of plastic film wound on a core with the traction device's tractional surface such that the leading edge of the roll contacts the tractional surface and the leading edge is rolled back upon successive revolutions of the rolls said contact sufficient to form a rolled tab.

2. The apparatus of claim 1 wherein the traction device is stationary and positioned in a plane above and substantially parallel to the conveyor means.

3. The apparatus of claim 2 wherein the traction device has at least one tractional surface of flexible material for grabbing and rolling the leading edge of a roll of plastic film such that a rolled tab for the roll of film is formed when a roll of plastic film comes in rotational contact with the traction device.

4. The apparatus of claim 3 wherein the tractional surface is a plurality of spaced apart flexible finger members releasably attached to a manifold block member along the longitudual surface of the block at an angle to the longitudual axis of the block.

5. The apparatus of claim 4 wherein the fingers are at a 45 degree angle.

6. The apparatus of claim 4 wherein the fingers are flat plate members wherein one side of the plate has a resilient tractional surface for grabbing the leading edge.

7. The apparatus of claim 6 wherein the tractional surface of the fingers comprises a plurality of grooves and ridges for grabbing the leading edge.

8. The apparatus of claim 6 wherein the fingers are generally rectangular in shape with one side having the roughened surface for grabbing the leading edge.

9. The apparatus of claim 8 wherein the fingers are multilayered comprising a body layer and a tractional surface layer, the tractional surface layer being of a different material than said body layer, and layered or coated to the body layer.

10. The apparatus of claim 1 wherein the means for rotating the roll of plastic film is a drive means for rotating the rollers of the conveyor line.

11. The apparatus of claim 1 wherein the means for rotating the roll of plastic film is a belt driven device means in contact with the top surface of the roll supported on the rollers.

12. The apparatus of claim 1 wherein the traction device is at least a pair of stationary manifold blocks with a tractional surface.

13. The apparatus of claim 1 including means for blowing air to the circumferential surface of the roll of film.

* * * * *